United States Patent [19]

Sandercock

[11] Patent Number: 5,076,343

[45] Date of Patent: Dec. 31, 1991

[54] DIE CAST PLUNGER LUBRICATION SYSTEM

[75] Inventor: Mark L. Sandercock, Menomonee Falls, Wis.

[73] Assignee: Briggs & Stratton Corporation, Wauwatosa, Wis.

[21] Appl. No.: 573,347

[22] Filed: Aug. 24, 1990

[51] Int. Cl.[5] ..... B22D 17/00

[52] U.S. Cl. ..... 164/267; 164/72

[58] Field of Search ..... 164/72, 267

[56] References Cited

U.S. PATENT DOCUMENTS 3,110,931 11/1963 Kadel .
3,544,355 12/1970 Ott .
3,613,772 10/1971 Carr .
3,767,012 10/1973 Jimi et al. .
3,779,305 12/1973 Pondelicek et al. .
4,420,028 12/1983 Nelson .
4,664,173 5/1987 Wolniak .

FOREIGN PATENT DOCUMENTS 548368 2/1977 U.S.S.R. .
627915 10/1978 U.S.S.R. ..... 164/72

OTHER PUBLICATIONS

Buhler brochure entitled "Flashtrol" published in about 1988.

*Primary Examiner*—Kuang Y. Lin
*Attorney, Agent, or Firm*—Andrus, Sceales, Starke & Sawall

[57] ABSTRACT

A lubrication system for the plunger of a die cast machine is disclosed that does not require a timing mechanism or an additional pressure source for the lubricant. The forward stroke of a lube piston is used to force lubricant out of a lubrication chamber in the plunger through a passageway to the outer surface of the plunger by decreasing the volume of the lubrication chamber. A spring within the plunger's lubrication chamber is used to retract the piston and thereby increase the volume of the lubrication chamber. The relatively low pressure during this retraction stroke allows lubricant to flow from a lubricant tank into the lubrication chamber for distribution during the next forward stroke of the plunger.

16 Claims, 2 Drawing Sheets

FIG. 1
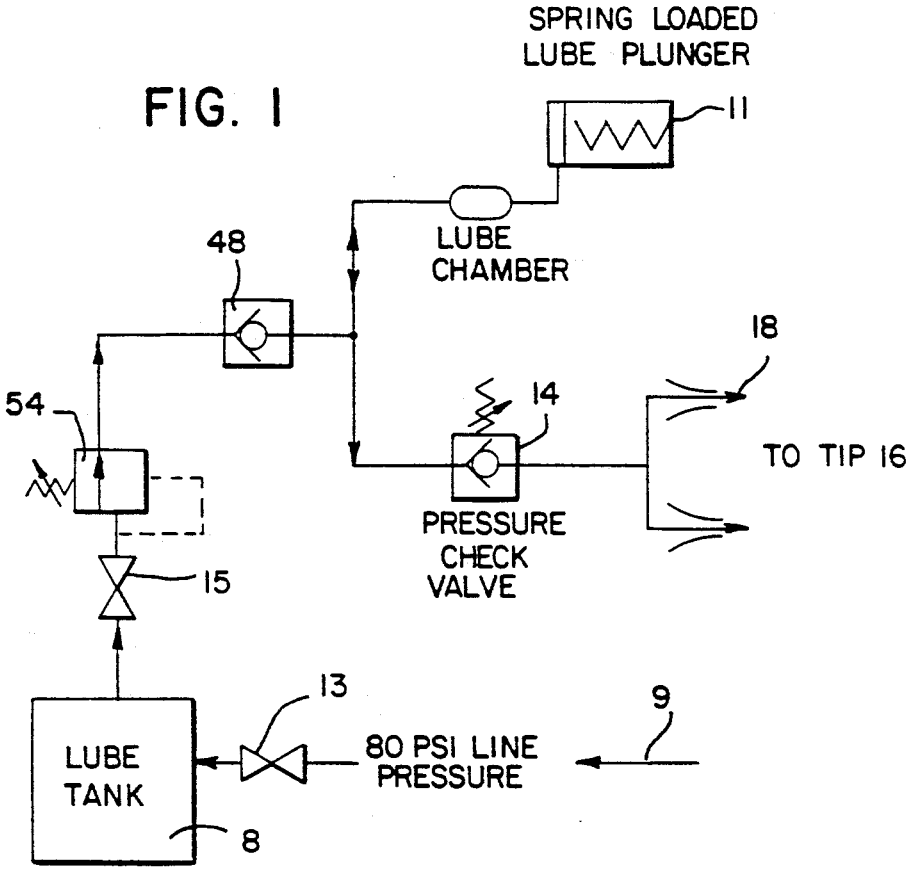
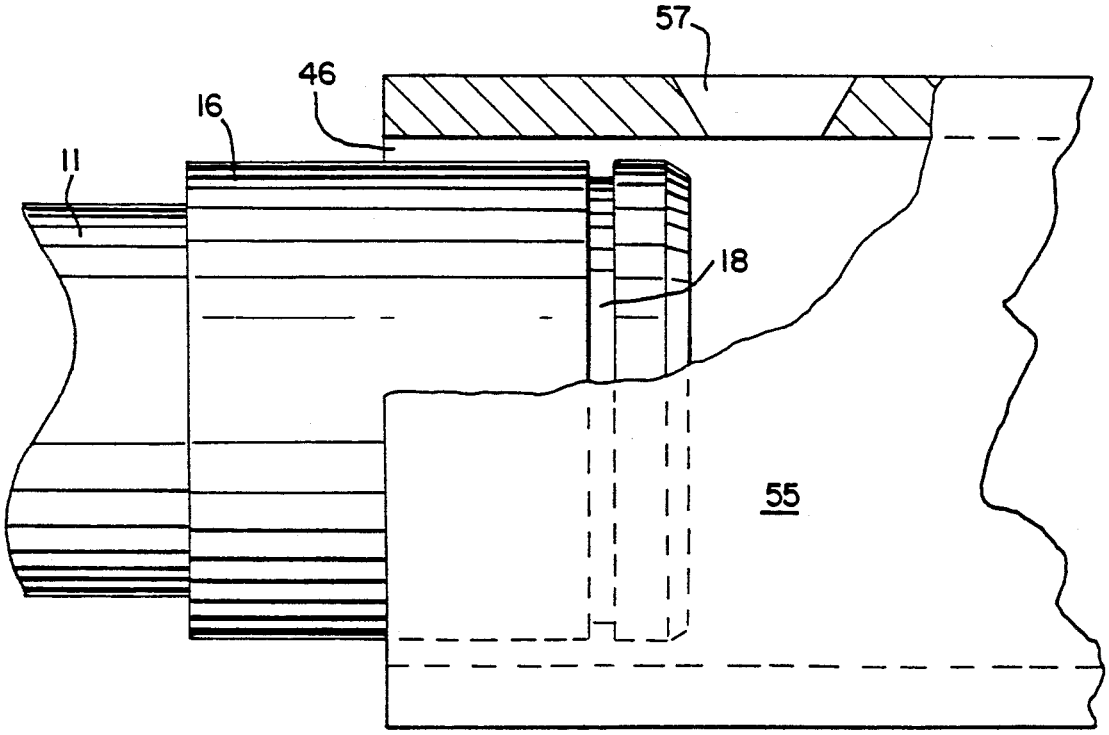
FIG. 3

FIG. 2
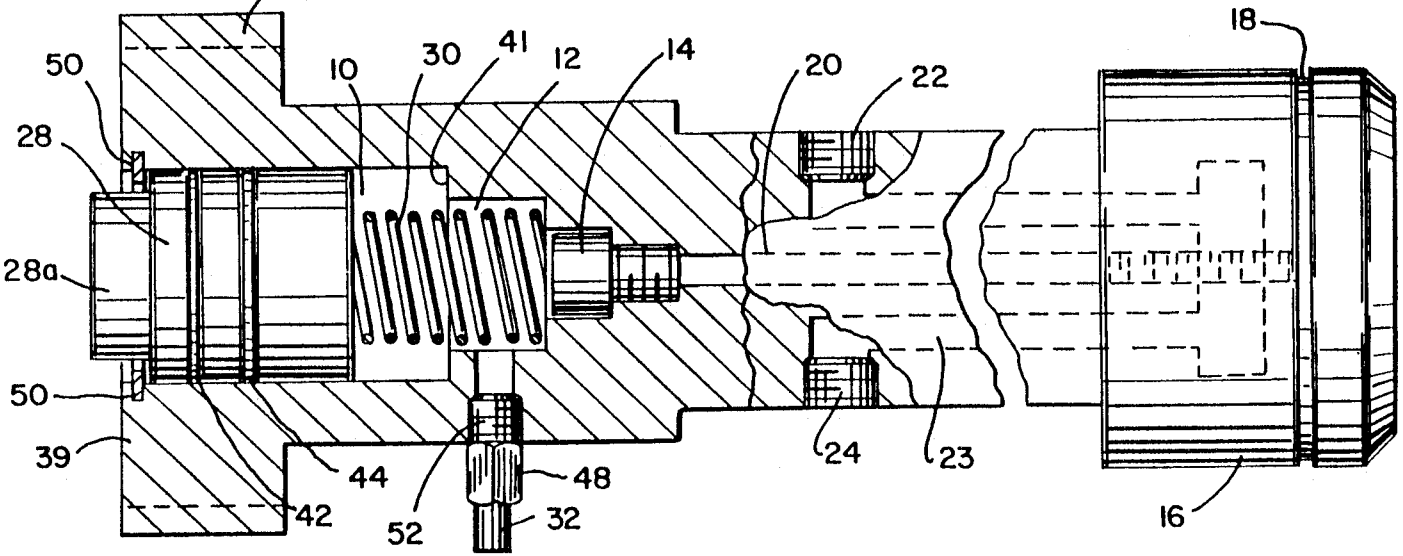
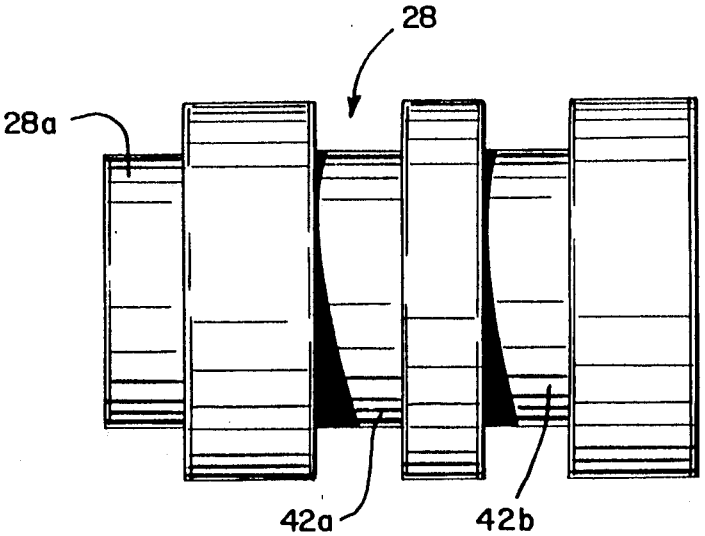
FIG. 4

DIE CAST PLUNGER LUBRICATION SYSTEM

BACKGROUND OF THE INVENTION

This invention relates to die casting equipment, and more particularly to a lubrication system for die casting equipment.

In die casting, molten metal is poured into a shot sleeve via a pour funnel. A plunger consisting of a plunger rod and a plunger tip is axially moved or extended into the shot sleeve to push the molten metal or "shot" into the die cast. It is necessary to both lubricate and cool the plunger due to the high temperatures, the presence of molten metal on the plunger tip and the plunger rod, and the friction between the plunger components and the shot sleeve.

In typical prior art plunger lubrication systems, a lubricant is sprayed from a pressurized lubrication source onto the plunger tip or into the shot sleeve via the pour funnel. This system has the disadvantages of being very messy since the sprayed lubricant has a tendency to scatter, and also is very inefficient and ineffective since the lubricant on the plunger rod and plunger tip may be unevenly distributed. Also, when the lubricant is sprayed into the shot sleeve and metal is poured into the sleeve, the lubricant has a tendency to burn, creating undesirable gases Other prior art lubrication systems use complicated hydraulics or electronic timing mechanisms by which a lubricant is provided to the plunger components in timed relation to the position of the plunger. Such systems also typically require an additional source of high pressure to enable the lubricant to be transported to the outer surface of the plunger. In short, such systems are complicated and expensive since they require additional component parts.

SUMMARY OF THE INVENTION

A lubrication system is disclosed for the plunger tip of a die cast machine. The lubrication system comprises a lubrication chamber formed within either the plunger rod or the plunger tip, and a first transport means for transporting lubricant from a pressurized lubricant tank to the lubrication chamber. The lubricant in the chamber is transported by a second transport means to the outer surface of the plunger in response to the increase of pressure within the lubrication chamber. In a preferred embodiment, the pressure applied to the lubricant in the lubrication chamber is increased by reducing the volume of the chamber using a lube piston that is axially movable within the plunger by a plunger movement means. Another pressure source such as a pressure line could be used to increase the pressure within the lubrication chamber.

The lube piston preferably has a step protrusion that engages the plunger movement means Movement of the lube piston applies pressure to the lubricant and forces it out of the lubrication chamber through a second transport means to the outer surface of the plunger.

The lubrication system may be retrofit onto existing die cast plungers by modifying the plunger to create the lubrication chamber and the first and second transport means. In the alternative, the plunger may be specially designed for use with the lubrication system according to the present invention.

Other features of the preferred embodiment include a cooling means for cooling the plunger by passing water or another coolant through a cooling passageway within the plunger tip. A volume increasing means such as a spring may also be used to increase the volume of the lubrication chamber after its volume has been decreased by the movement of the lube piston. The spring also resists some of the initial inertia of the moving lube piston, slightly delaying the output of the lubricant until the plunger tip has passed the pour hole for the molten metal. Thus, lubricant does not flow out of the pour hole, as in typical prior art spray lubrication systems.

In a preferred embodiment, the second pressure means used for increasing the pressure within the lubricant source is the standard industrial shop compressed air line, so that no additional pressure source such as a pump is required as in prior art devices.

Lubricant is drawn into the lubrication chamber while the lube piston is being retracted, and is forced out of the lubrication chamber by the lube piston while the plunger is being axially extended into the shot sleeve without the need for hydraulic or electronic timing devices as required in prior art lubrication systems It is a feature and advantage of the present invention to provide a die cast lubrication system that is inexpensive and has fewer components than prior art systems.

It is another feature and advantage of the present invention to use the force transmitted by a standard die cast plunger movement means to transport lubricant to the outer surface of the plunger.

It is yet another feature and advantage of the present invention to provide a die cast lubrication system which more evenly distributes the lubricant on the outer surfaces of the plunger components and on the internal surface of the shot sleeve.

These and other features and advantages of the present invention will be apparent to those skilled in art from the following detailed description of the preferred embodiments and the attached drawings, in which:

BRIEF DESCRIPTION OF THE DRAWINGS

FIG. 1 is a pressure flow diagram of the lubrication system according to the present invention;

FIG. 2 is a side view, shown in partial section, of a plunger tip and plunger rod containing the lubrication system according to the present invention;

FIG. 3 is a side view of a plunger tip when it is inside the shot sleeve; and FIG. 4 is a side view of a lube piston according to the present invention.

DETAILED DESCRIPTION OF PREFERRED EMBODIMENTS

Referring to the pressure flow diagram depicted in FIG. 1, a standard shop 80 PSI air pressure line 9 applies pressurized air through a valve 13 to a lube tank 8 containing a lubricating fluid such as oil. The lubricating fluid is transported under pressure through valve 15 and through an optional regulator 54. Regulator 54 is designed to control pressure in the line.

The lubricant then passes through a one-way lube check valve 48 which prevents lubricant from entering the lubrication chamber while lube plunger 11 is moving in its forward stroke. An optional 80 PSI pressure check valve 14 controls the pressure of the lubricant flowing from the lubrication chamber to lube groove 18. Lubricant flows out of lube groove 18 to the outer surface of the plunger rod or of plunger tip 16.

FIG. 2 is a sectional side view of a plunger incorporating the present invention. As used herein, the term "plunger" includes both the plunger tip and the plunger rod. In FIG. 2, lubricant flows from lube tank 8 (FIG. 1) through lube line 32, lube check valve 48, and lube tap 52 into a lubrication chamber consisting of lube pocket 10 and counterbore 12. At its widest point, the lubrication chamber may be about 1.5 inches in diameter. Of course, the volume of the lubrication chamber is dependent upon the amount of lubricant needed on the outer surface of the plunger. Check valve 48 is a one-way check valve that is designed to prevent lubricant from flowing in the reverse direction out of the lubrication chamber into lube line 32 during the axial movement of lube piston 28 toward the shot sleeve.

When the shot cylinder (not shown) of the die cast machine retracts, spring 30 and the 80 PSI lubricant pressure force cause lube piston 28 to move in an axial direction away from the shot sleeve, thereby increasing the volume and decreasing the pressure within the lubrication chamber. The decreased pressure allows lubricant to flow into lube pocket 10 from lube tank 8 (FIG. 1) via lube line 32.

The amount of lubricant which flows into the chamber is also partially determined by the length of step protrusion 28*a* of lube piston 28 as discussed below.

During the forward stroke, the die cast shot cylinder (not shown) abuts step protrusion 28*a* and moves it along with lube piston 28 until protrusion 28*a* is flush with edge 39 of plunger 11. Thus, the width of step protrusion 28*a* partially determines the volume by which the lubrication chamber is decreased during the forward stroke, and therefore partially determines the volume of lubricant forced out of the lubrication chamber. Step protrusion 28*a* may be about 0.25 inches long. The diameters of lube pocket 10 and counterbore 12 also affect the volume of lubricant forced out of the lubrication chamber.

Edge 39 of plunger 11 provides a positive stop preventing lube piston 28 from moving any further. Spring 30 also tends to prevent piston 28 from applying too much pressure to edge 41, thereby minimizing damage to piston 28 and plunger 11.

Lube piston 28 preferably has two high pressure seals 42 and 44, often called T-seals, to prevent leakage of the lubricant in lube pocket 10 out of the plunger assembly. A retainer means such as E-clip 50 is used to prevent lube piston 28 from being drawn out of plunger 11 while piston 28 is being retracted during the plunger backstroke.

Since the pressure applied by lube piston 28 may be very high, an optional pressure check valve 14 may be included to control the pressure of the lubricant in lube passageway 20. In any event, lubricant passes from lube pocket 10 to counterbore 12, and thereafter through lube passageway 20 to the outer surface of the plunger tip 16 via lube groove 18 therein. A typical plunger tip is about 2.5 inches in diameter. Lube passageway 20 is preferably about 0.25 inches in diameter and is bored into the center of the plunger rod and the plunger tip. Conventional plungers may be modified to create lube passageway 20 if the location of coolant line 23 does not interfere with the lube passageway. Lube groove 18 is about 0.010 to 0.015 inches wide and has a depth that is approximately equal to its width.

Although the Figures depict the lubricant passing all the way to the plunger tip, it is apparent that the lubricant may be output to the outer surface of the plunger rod instead and still be within the scope of the present invention. In addition, it may be desirable to use radial holes or other conduits from the lube passageway to the outer surface of either the plunger rod or the plunger tip to distribute the lubricant instead of an annular groove as depicted in the drawings.

Water or another coolant is input through a tap 22 into line 23 to cool the plunger rod and the plunger tip. The heated coolant is then passed out of the plunger assembly through tap 24.

FIG. 3 depicts plunger 11 while plunger tip 16 is in shot sleeve 55. In FIG. 3, molten metal is poured through pour hole 57 into shot sleeve 55. Thereafter, plunger 11 extends axially to move plunger tip 16 into shot sleeve 55 while at the same time lubricant from the lubrication system is distributed through lube groove 18 onto the outer surface of tip 16 and throughout the annular space 46 between tip 16 and the internal surface of shot sleeve 55. Annular space 46 is approximately 0.003 inches in diameter, and has a length determined by the length of plunger tip 16 that is inserted into shot sleeve 55. This length is typically about 18 inches.

FIG. 4 is a side view of a lube piston 28 according to the present invention. In FIG. 4, piston 28 has a step protrusion 28*a* which engages the shot cylinder (not shown) of the die cast machine, as described above. Piston 28 also has annular grooves 42*a* and 44*a* for receiving high pressure seals 42 and 44 respectively, as shown and described in connection with FIG. 2.

Although several embodiments of the present invention have been shown and described, other alternate embodiments will be apparent to those skilled in the art and are within the intended scope of the present invention. Therefore, the invention is to be limited only by the following claims.

I claim:

1. A lubrication system for a die cast machine, said die cast machine including a plunger having an outer surface and said plunger also having a plunger rod and a plunger tip, and including plunger movement means for axially extending said plunger, said lubrication system comprising:

a lubrication chamber within said plunger;

first transport means for transporting a lubricant to said lubrication chamber;

first pressure means for increasing the pressure within said lubrication chamber in response to the plunger movement means; and second transport means for transporting lubricant from said lubrication chamber to the outer surface of said plunger in response to increased pressure within said lubrication chamber.

2. The lubrication system of claim 1, further comprising:

a lubricant source interconnected with said first transport means.

3. The apparatus of claim 2, further comprising:

second pressure means for increasing the pressure within said lubricant source.

4. The lubrication system of claim 1, further comprising:

a lube check valve interconnected with said first transport means.

5. The lubrication system of claim 1, wherein said first pressure means includes:

a lube piston located within said plunger and adjacent said lubrication chamber, said lube piston being adapted to move axially within said plunger in response to the plunger movement means to both increase the pressure within and decrease the volume of said lubrication chamber.

6. The lubrication system of claim 5, wherein said lube piston has a step protrusion for engagement with said plunger movement means.

7. The lubrication system of claim 5, wherein said lube piston has at least one pressure seal on its outer surface.

8. The lubrication system of claim 5, further comprising:

volume increasing means for increasing the volume of said lubrication chamber after said volume has been decreased by said lube piston.

9. The lubrication system of claim 8, wherein said volume increasing means includes a spring.

10. The lubrication system of claim 1, wherein said second transport means includes a passageway within said plunger.

11. The lubrication system of claim 1, wherein said second transport means transports lubricant to the outer surface of said plunger tip.

12. The lubrication system of claim 11, wherein said second transport means includes an annular groove on the outer surface of said plunger tip.

13. The lubrication system of claim 1, further comprising:

a pressure check valve connected between said lubrication chamber and said second transport means.

14. The lubrication system of claim 1, further comprising:

a regulator interconnected with said first transport means that regulates the flow of lubricant within said first transport means.

15. The apparatus of claim 1, further comprising:

cooling means for cooling said plunger tip.

16. The apparatus of claim 15, wherein said cooling means includes a cooling passageway within said plunger tip.

* * * * *